United States Patent [19]

MacMaster et al.

[11] 4,296,298

[45] Oct. 20, 1981

[54] DIELECTRIC COOKING APPARATUS

[75] Inventors: George H. MacMaster, Lexington; Kenneth W. Dudley, Sudbury, both of Mass.

[73] Assignee: Raytheon Company, Lexington, Mass.

[21] Appl. No.: 91,004

[22] Filed: Nov. 5, 1979

Related U.S. Application Data

[63] Continuation of Ser. No. 914,694, Jun. 12, 1978, abandoned.

[51] Int. Cl.[3] ..... H05B 6/54

[52] U.S. Cl. ..... 219/10.81; 219/10.75

[58] Field of Search ..... 219/10.81, 10.75, 10.77, 219/10.53, 10.55 R, 10.55 E, 10.69

[56] References Cited

U.S. PATENT DOCUMENTS

| | | | |
|---|---|---|---|
| 2,321,131 | 6/1943 | Crandell | 219/10.81 |
| 2,582,806 | 1/1952 | Nes et al. | 219/10.81 |
| 2,618,733 | 11/1952 | Reed et al. | 219/10.81 |
| 3,082,710 | 3/1963 | Holland | 219/10.81 |
| 3,436,642 | 4/1969 | Segsworth | 219/10.75 X |
| 3,591,751 | 7/1971 | Goltsos | 219/10.55 R |
| 3,857,009 | 12/1974 | MacMaster et al. | 219/10.55 E |
| 3,946,187 | 3/1976 | MacMaster et al. | 219/10.55 E |
| 4,055,295 | 10/1977 | Cohn | 219/10.81 |
| 4,119,826 | 10/1978 | Chambley et al. | 219/10.81 |

*Primary Examiner*—Richard R. Kucia
*Assistant Examiner*—Philip H. Leung
*Attorney, Agent, or Firm*—William R. Clark; Milton D. Bartlett; Joseph D. Pannone

[57] ABSTRACT

A dielectric heating oven having a set of parallel spaced electrodes alternately grounded and every ungrounded electrode fed by electromagnetic energy from a common source in an ISM band preferably from 13.56 megacycles to 40.68 megacycles. Food is placed on top of the electrodes and the depth of penetration of the electric fields into the food is a function of the phase relationship of the energized electrodes. When all energized electrodes are feed in the same phase, maximum field coupling is to the grounded electrodes between them resulting in high intensity searing electric fields close to the surface of the food. Deeper penetration cooking is accomplished by feeding adjacent energized electrodes 180° out of phase so that maximum field coupling is between them rather to the grounded electrode between them. Still further penetration cooking results from feeding all adjacent energized electrodes 90° out of phase so that maximum field coupling is to alternate energized electrodes.

3 Claims, 5 Drawing Figures

DIELECTRIC COOKING APPARATUS

This is a continuation of application Ser. No. 914,694, filed June 12, 1978, now abandoned.

BACKGROUND OF THE INVENTION

Dielectric heating has been well-known in the heating art for many years. Cooking, bonding, drying and similar processes are accomplished by subjecting a dielectric material to a high frequency alternating electric field that produces heat in the material resulting from molecular friction. The field penetrates the material such that, even in the interior the heating process substantially begins at the instant the electric field is applied. This is contrasted to conventional conduction heating where thermal energy is gradually conveyed from the surface of the material toward the center and the interior remains "cold" for some period of time. The field penetration thus described has the advantage of heating much more rapidly than by conduction but it also has the disadvantage associated with it of difficulty in controlling the depth of penetration. Particularly in the application of cooking, it is important to have the surface of the food maintained at a high enough temperature for a period long enough to brown or sear the surface of meat.

A number of techniques have been used in the microwave heating art to achieve a browned food surface while cooking. One method includes the incorporation of auxiliary electric or gas broiling elements. Another approach is to coat the food with an additive that exhibits a dielectric characteristic producing increased food surface temperatures. Another concept is presented in U.S. Pat. Nos. 3,857,009 and 3,946,187, both issued to the inventors herein and assigned to the assignee of the present invention. They disclose structures which mount in a microwave field and upon which food is placed. The microwave energy induces currents in the structures having intense alternating electric fringing fields in close proximity of the food with said fields rapidly decaying a short distance from the food surface. However, in the dielectric heating art, a cooking means is still required for controlling the depth of penetration for individual preferences and a variety of foods with different shapes and sizes.

SUMMARY OF THE INVENTION

A set of electrodes coupled with common source RF signals having mutually different phases is positioned in one plane such that the electrodes are spaced apart substantially less than a wavelength of the signals. Preferably, the electrodes are elongated and parallel. Food may be placed on top of the electrodes and cooked by dielectric heating. The RF frequency may be in an ISM band between 13.56 megacycles and 40.68 megacycles or at a lower frequency.

Preferably, only the alternate electrodes are energized with RF signals while the remaining electrodes are grounded. Also, it is preferable that the phase difference of the signals be selectable. Therefore, the operator of the oven can control the depth of penetration of the cooking. For example, some enjoy steaks that are seared on the outside while pink on the inside; others prefer steak that is more evenly done throughout. Ideally, the operator can select between phase differences of 90°, 180° and 270°.

BRIEF DESCRIPTION OF THE DRAWINGS

Details of the invention will be readily understood after consideration of the following description of an illustrative embodiment in reference to the accompanying drawings, wherein.

DESCRIPTION OF THE PREFERRED EMBODIMENT

Figure 1:
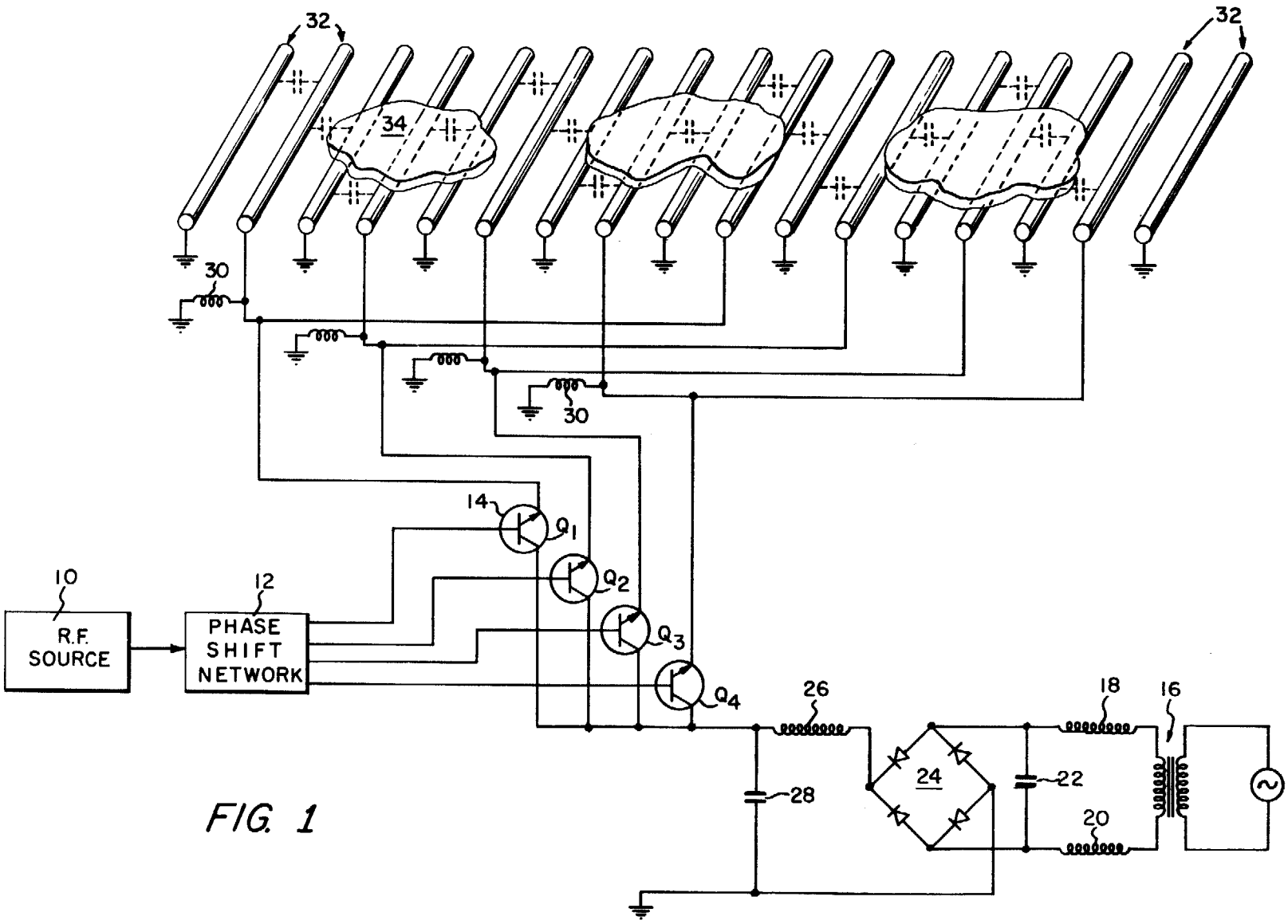
FIG. 1 is a schematic diagram illustrating the circuitry of an induction cooking apparatus constructed in accordance with the present invention.

Referring to FIG. 1, a radio frequency (RF) source 10 is shown which preferably provides an output in an Industrial, Scientific, and Military (ISM) band between the frequencies of 13.56 megacycles and 40.68 megacycles although frequencies as low as 500 kilohertz (KHz) could be used. These sources are readily available in the art.

The output of the RF source is connected to a phase shift network 12 which preferably provides four outputs having substantially equal peak voltages and oscillating at the input frequency of the network. It is also preferable that a control be provided such that the operator can select the phase relationships from the four outputs as shown in Table 1 below.

TABLE I

| MODE | Relative Phase of Output To | | | |
|---|---|---|---|---|
| | Q1 | Q2 | Q3 | Q4 |
| 1 | 0° | 0° | 0° | 0° |
| 2 | 0° | 180° | 0° | 180° |
| 3 | 0° | 90° | 180° | 270° |

As described hereinafter, Mode 1 will provide an intense fringing field that will sear the surface of the food. Mode 3 is used to obtain deeper penetration cooking while Mode 2 is an intermediate selection. Phase shifting devices are commercially available in the frequency range herein specified. An alternate method of accomplishing the required function is to provide a four way voltage divider, the outputs of which may selectively be fed through an inductor and capacitor circuit for phase shifting. Also, the phase relationships may be variable between the discrete value shown in Table 1.

Each output of the phase shift network is connected to an amplifier 14 as shown in FIG. 1. Each amplifier may be comprised of a single power transistor Q1–Q4 such as, for example, a Power Hybrid PH 8296 or a plurality of transistors. Commercially available vacuum tubes may also be used. As shown in FIG. 1, the power transistor collector may be connected to a 60 Hz, 115 volt AC to DC power supply comprising a step-down transformer 16, radio frequency interference (RFI) filter comprising series conductors 18 and 20 and shunt capacitor 22, a diode bridge 24, and storage components inductor 26 and capacitor 28. The supply is of conventional design and functions to provide emitter bias of typically 31 volts. As connected in the preferred embodiment, the power transistor is turned on and off at a high frequency switching rate which is specifically, the frequency the RF source. Each amplifier stage of any design preferably delivers output power in the range of 100 to 300 watts to its load comprising an inductor 30, electrodes 32 and food 34. Using four amplifiers as shown in FIG. 1, the total power of output of the oven is in the range of 400 to 1200 watts. A control may be provided for varying the gain of the amplifiers to select different cooking levels such as low, medium and high.

Figure 2:
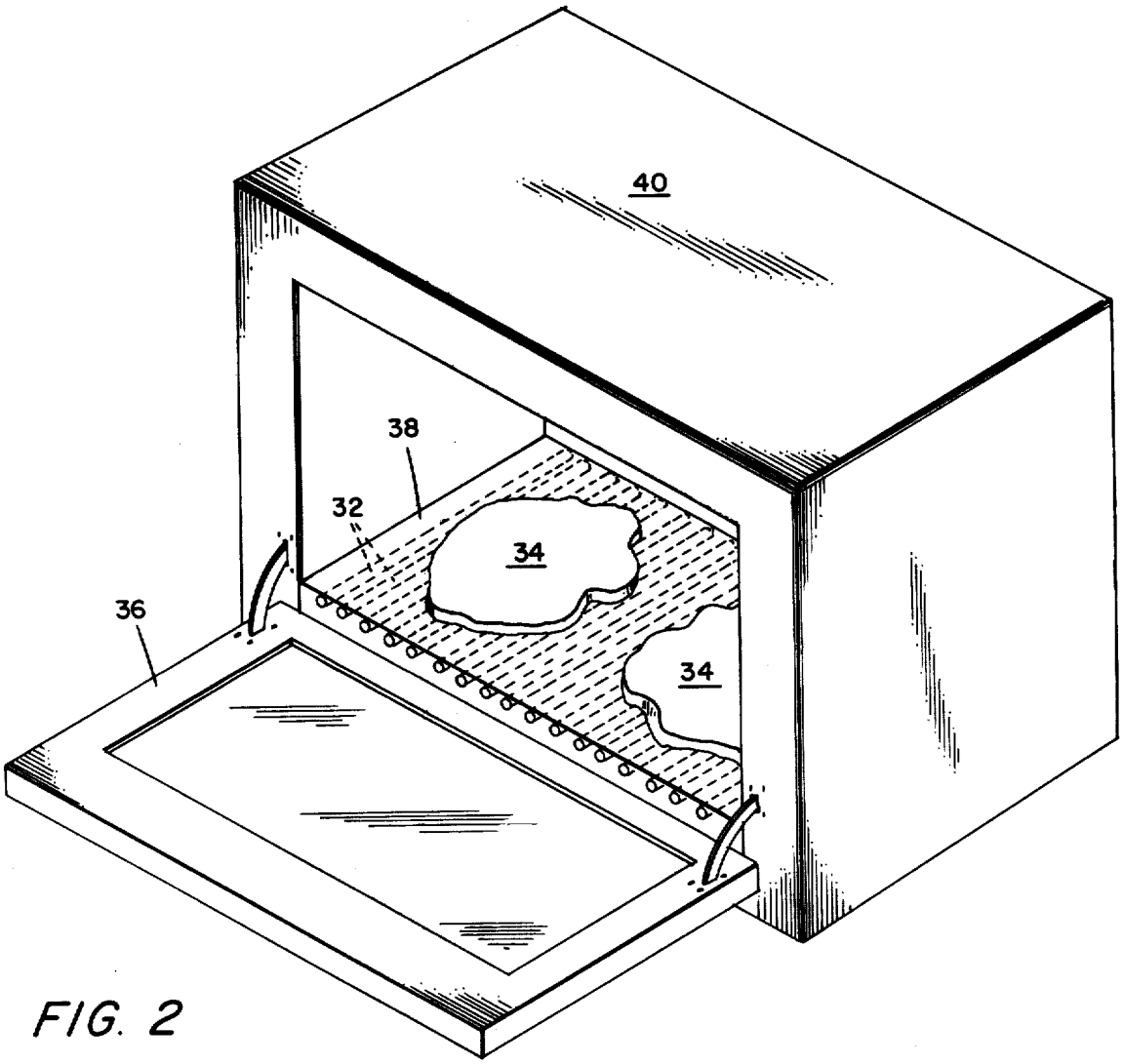
FIG. 2 shows an induction cooking oven with electrodes and food.

The output of each amplifier stage drives the inductor to ground in parallel with at least one electrode. The inductor to ground provides a DC path from the ground of the power supply through the diode bridge, inductor 26 and a transistor. The electrodes as shown in FIG. 1 and illustrated in FIG. 2 are preferably fabricated of a metallic conductor such as stainless steel. They, in effect, comprise the plates of capacitors and dielectric materials between these plates, or in this application, adjacent to the plates, completes the capacitors. More specifically, the material is food to be cooked that is placed on top of the electrodes. The combination of an inductor in parallel with at least one effective capacitor form a tank circuit. The value of an inductor preferably is in the order of one millihenery so that the resonance frequency of the circuit will be higher than the RF source frequency. Referring to FIG. 1, each amplifier stage energizes two electrodes as shown with every alternate electrode grounded. The effective circuit is an inductor in parallel with two parallel compacitors.

Although many variations are operable, the preferred embodiment utilizes seventeen electrodes as shown in FIG. 2. Each electrode is twelve inches long and has a diameter of one-quarter inch. Either hollow or solid electrodes may be used. The electrical connection to the electrode may be crimped or plugged among other methods. The electrodes may be encased in a conventional low loss material 38 that is substantially transparent to the electromagnetic field energized by the electrodes. Examples are PYROCERAM which is a ceramic material and polysulfone which is a plastic. Polysulfone has high temperature resistant properties and is used commercially in 400° F. applications. A thin layer of the material may be placed over the electrodes defining a flat surface approximately one-sixteenth to one-eighth inch above the electrodes upon which food is placed for cooking. The layer may be removed for cleaning. Another embodiment utilizes a mounting structure fabricated from the same ceramic or plastic material which supports the electrodes but leaves them exposed so that food is placed directly on the electrodes. Still another embodiment defines two planes of electrodes such that the food is placed between them and cooking is performed on both sides simultaneously.

At the frequencies herein specified, the wavelength of energy coupled to an electrode is substantially longer than the electrode length of twelve inches. For example, at 13.56 megacycles, the wavelength is approximately 72.5 feet. Accordingly, no standing waves are set up on an electrode as they would be at higher microwave frequencies. Rather, the instantaneous voltages along the length of a given energized electrode will be approximately equal. As shown in FIG. 2, the elongated electrodes encased in polysulfone are parallel. Accordingly, voltage gradients for corresponding points of two electrodes, although varying as a function of time unless the electrodes are fed in phase, will be instantaneously the same for the entire length of the electrodes.

Figure 3:
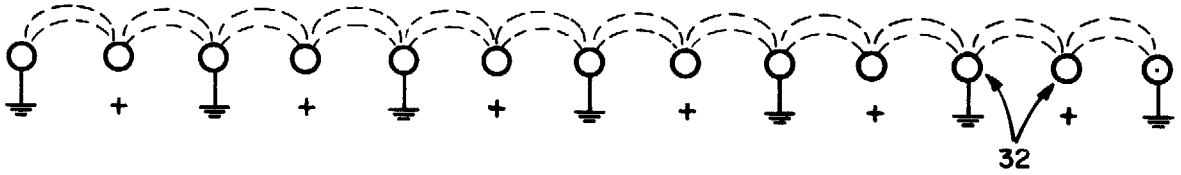
FIG. 3 shows an electrode phase relationship for food surface searing.
Figure 4:
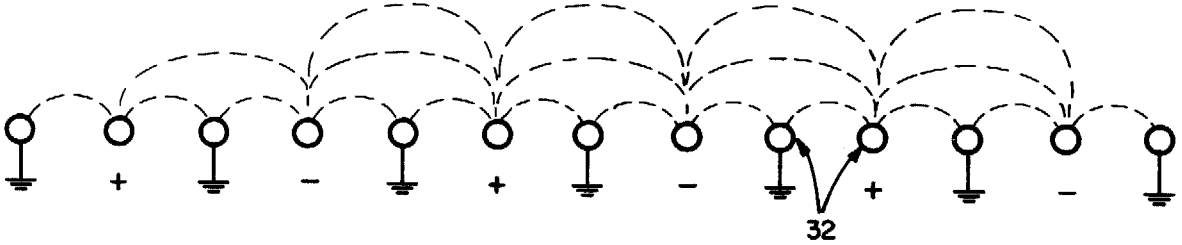
FIG. 4 shows an electrode phase relationship for moderate penetration cooking.
Figure 5:
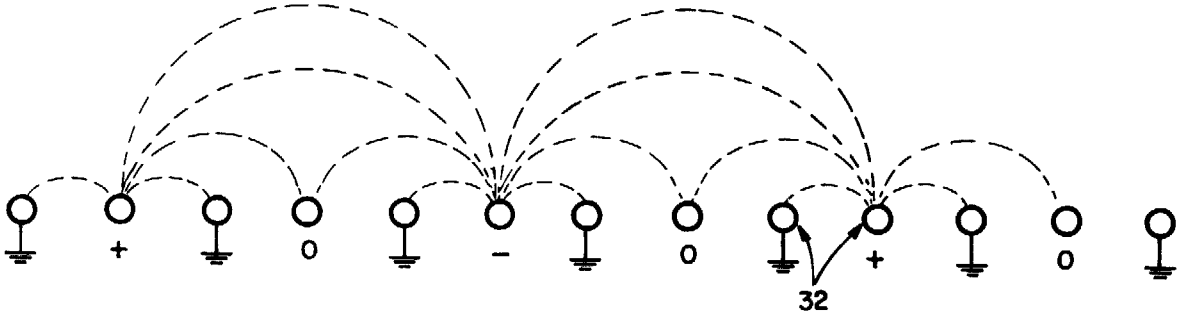
FIG. 5 shows an electrode phase relationship for deep penetration cooking.

A voltage gradient between two electrodes causes an electric field to couple between them. Equal potential flux lines are depicted in FIGS. 3, 4 and 5. For illustration, only thirteen electrodes are shown in each figure. The field couples directly into food placed on top of the electrodes causing electric current to be induced in the dielectric food. The alternating currents in the food create molecular frictional heat producing cooking of the food. The theory of this dielectric heating is well documented in the heating art. The field strength and accordingly the dielectric heating is a function of the voltage gradient between the electrodes. Typically, the invention uses voltage gradients on the order of 100 volts per inch.

As shown in FIG. 3, when alternate electrodes are fed in phase, an energized electrode couples to a grounded electrode adjacent to it. Although the maximum voltage potential between the two is only half the peak voltage excursion of the energized electrode, the voltage gradient between the two is still relatively large because the electrodes are close to each other. It is also noted that the field between them is concentrated near the plane formed by the electrodes. Cooking with the phasing mode as shown in FIG. 3 and represented in Table 1 as mode 1 would result in an intense fringing field that would cause searing of the surface of the food with relatively little dielectric penetration heating.

FIG. 4 illustrates the electrode coupling of mode 2 in Table 1. As the alternate electrodes are fed 180° out of phase, a large voltage gradient occurs between them resulting in a strong field between them in addition to the field between the energized and grounded electrodes that are relatively closely spaced. Accordingly, this mode produces a complex field where an increased percentage of the field strength is further away from the electrode plane than in mode 1 of Table 1. This results in deeper penetration cooking and less searing. The coupling of mode 3 of Table 1 is illustrated in FIG. 5. As can be seen this mode of cooking would produce deeper penetration cooking than mode 1 or mode 2 of Table 1.

FIG. 2 shows food being cooked over the electrodes inside an oven 40. The door 36 for the frequency herein specified is much simpler and less expensive to construct than the doors required for microwave ovens which provide sealing.

After reading this disclosure, many modifications will be evident to one skilled in the art without departing from the intended spirit and scope of the invention. For example, the invention is operable over a variety of frequencies, phase relationships, numbers and kinds of amplifiers, and numbers and kinds of electrodes. Therefore, it is intended that the scope of this invention be limited only by the claims and not by the description of the embodiments here above described.

What is claimed is:

1. A dielectric heating oven comprising:

an enclosure;

a source of RF energy;

means for substantially terminating both ends of electric fields in a plane, said terminating means comprising a plurality of at least four elongated parallel electrodes positioned in said plane in said enclosure and spaced apart substantially less than a free space wavelength of said energy;

means for electrically grounding alternate electrodes of said plurality;

means for coupling said RF energy from source to the remaining ungrounded electrodes of said plurality for cooking food positioned adjacent to said plane, said coupling means comprising means for selecting between deep or shallow cooking effects in said food, said selecting means including means for selectively varying the phase difference between the phase of energy coupled to one of said ungrounded electrodes and the phase of energy coupled to a second of said ungrounded electrodes; and said phase difference is selectable between approximately 90°, 180° and 270° out of phase.

2. The oven recited in claim 1 wherein said electrodes comprise stainless steel conductors.

3. The oven recited in claim 1 wherein said electrodes are encased in a low loss material.

* * * * *